United States Patent [19]

Danielak et al.

[11] Patent Number: 4,832,339

[45] Date of Patent: May 23, 1989

[54] TOY BOWLING GAME

[75] Inventors: Ann C. Danielak, Oak Park; Michael A. Andersen, Chicago; Harry Disko, South Barrington, all of Ill.

[73] Assignee: Marvin Glass & Associates, Chicago, Ill.

[21] Appl. No.: 151,827

[22] Filed: Feb. 3, 1988

[51] Int. Cl.[4] ..... A63D 3/00

[52] U.S. Cl. ..... 273/45; 273/393

[58] Field of Search ..... 273/45, 127 R, 393

[56] References Cited

U.S. PATENT DOCUMENTS 2,095,513 10/1937 Reznick ..... 273/45 X 2,126,082 8/1938 Bailey ..... 273/45

*Primary Examiner*—Anton O. Oechsle

*Attorney, Agent, or Firm*—John S. Pacocha

[57] ABSTRACT

A toy bowling game for young children includes a soft bowling ball and a ramp providing an angled bowling surface. Adjacent the raised end of the ramp are a number of wells with a pin elastically tethered to the bottom of each well. Each pin has a rounded bottom that fits into a depression adjacent the front upper edge of its respective well for setting up the pin. The underside of a flange on the pin, which is above and around the rounded bottom, engages the bowling surface.

7 Claims, 1 Drawing Sheet

10
12
14
16
16
22
40
42
44

14
16
24
22
20
3
26
18
28
30
32
16
18
24
22
26
28
30
20
3
32

4
28
18
30
14
20
16
4

26
14
28
30
20
32

TOY BOWLING GAME

BACKGROUND OF THE INVENTION

1. Field of the Invention

This invention relates generally to bowling apparatuses and more particularly to toy bowling apparatuses.

2. Background Art

Bowling has long been a popular sport or game enjoyed by both adults and children. There have been numerous portable bowling apparatuses in the prior art. It is desirable to have the pins somehow attached to the portable apparatus to prevent their being misplaced. Accordingly, one problem sought to be solved in the prior art is the retention and resetting of the pins. Powell U.S Pat. No. 1,224,322 issued May 1, 1917 discloses a bowling apparatus in which pins of the usual form are attached by resetting cords to a vane connected to a lever at the other end of the alley. It appears, however, that when a pin of the Powell apparatus is knocked down, it may remain in the way of the other pins because the cord then precludes its removal from the bowling surface. Voges U.S. Pat. No. 2,535,973 issued Dec. 26, 1950 shows a toy tenpin game in which silhouettes of the pins are pivotally attached to a box-like support structure. However, the Voges pin silhouettes are so arranged that if the number one pin is struck, the remaining pins will fall. There remains a need for a toy bowling game for younger children in which the pins are attached to the bowling alley so as not to interfere with each other and which will provide a different result when the pins are hit.

SUMMARY OF THE INVENTION

The present invention is concerned with providing a toy bowling game for young children in which the pins are each tethered to a respective receiving well and are each positionable adjacent the upper front edge of the pin's respective well. A ramp with an angled bowling surface provides a raised end for recessing the wells. Each pin has a rounded bottom which fits into a depression in the bowling surface adjacent the forward upper edge of the respective well for setting up the pin. Above and around the rounded bottom, the pin has a flange, the underside of which engages the bowling surface.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
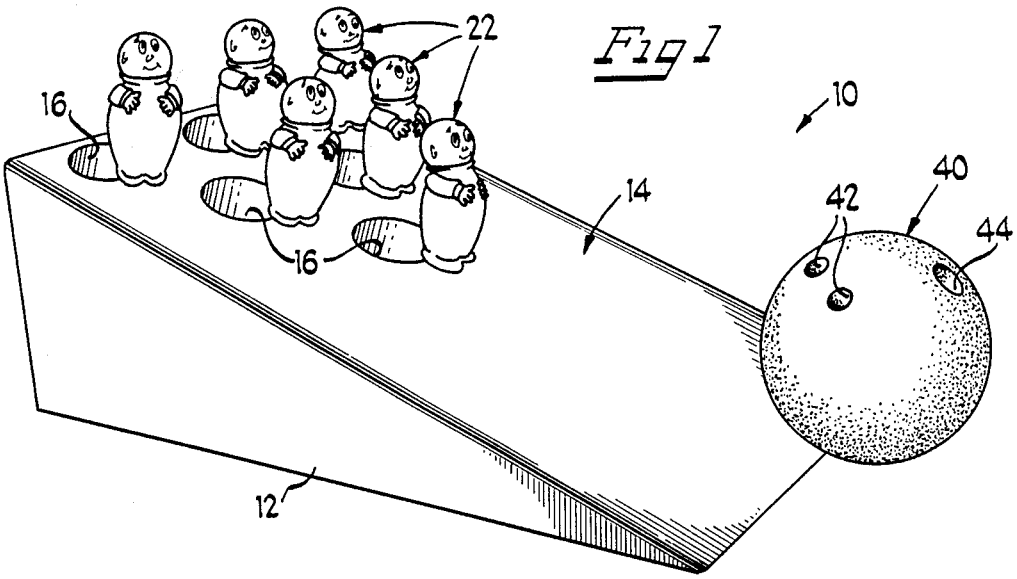
FIG. 1 is a perspective view of an embodiment of the present invention.

Referring now to the drawings in which like parts are designated by like reference numerals throughout the several views, FIG. 1 shows a toy bowling game 10 including a lightweight hollow molded plastic, bowling ramp 12. The ramp provides a generally planar bowling lane surface 14 that angles upwardly from a supporting surface at the front, ball throwing, edge to a raised back edge.

Six open wells or cups 16 are recessed below surface 14 from adjacent the raised back edge in a "three-two-one" triangular formation. At the forwardmost part of the front "one" well 16, angled bowling surface 14 is still raised enough above the supporting surface to accommodate the depth of the "one" well. Each well 16 is integrally formed as part of ramp 12 and is generally cylindrical with a bottom wall 18. Where the upper front edge of each well meets surface 14, there is a partially spherical or rounded depression 20 in surface 14. Depression 20 extends toward the front end of surface 14 forwardly of a plane that is tangent to the forwardmost upper edge of the well and substantially parallel to the front edge of surface 14.

Figure 2:
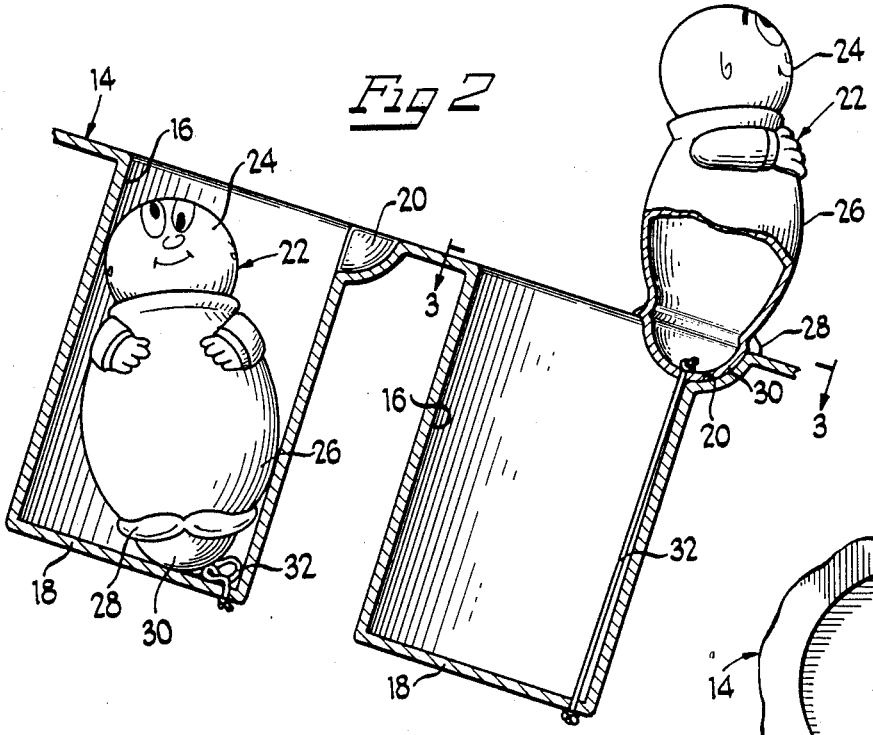
FIG. 2 is an enlarged scale, vertical sectional view taken generally along aligned diameters of two, front to back, adjacent wells.
Figure 3:
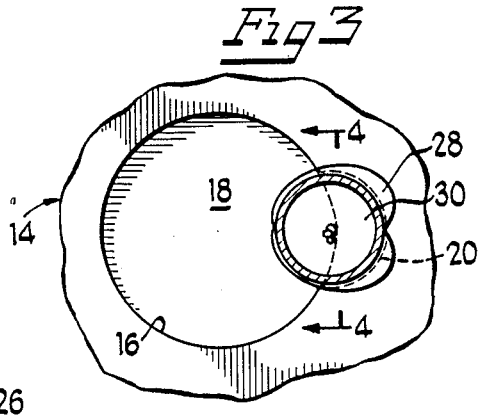
FIG. 3 is a sectional view taken generally along line 3—3 of FIG. 2.
Figure 4:
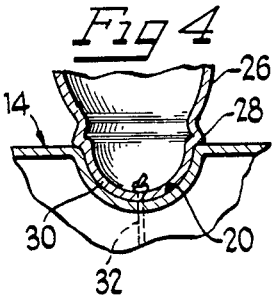
FIG. 4 is a sectional view taken generally along line 4—4 of FIG. 3.

Game 10 is also provided with six pins 22, each of the same height or length and styled as a character with a head 24, a body 26 and a foot flange 28. Below flange 28, each character has a hemispherical or rounded bottom 30. As is illustrated in FIGS. 2, 3 and 4, flange 28 is above and around all of bottom 30. The outside radius of the hemispherical bottom is sustantially the same as the radius of depression 20 so that any radial half of bottom 30 fits into depression 20. Hence, although the character pins have a definite front, it is not necessary that they be oriented in any particular position for their proper setting.

Each character pin 22 is tethered to the bottom of its respective well 16 by an elasticized tether or cord 32. One end of the elasticized cord is secured to the bottommost part of rounded bottom 30 and the other end of the elasticized cord is secured near the forwardmost point of bottom wall 18. The length of elasticized cord 32, in the unstretched state, is less than the distance from the bottom of the well to the bottom of pin 22 when the pin is set up as illustrated in FIG. 1 and the right-hand part of FIG. 2. Accordingly, when pin 22 is set up with bottom 30 in depression 20, elasticized cord 32 is stretched and exerts part of a biasing force maintaining the underside of flange 28 and rounded bottom 30 in contact with surface 14 and depression 20, respectively. Also included in toy bowling game 10 is a bowling ball 40 that is preferably a soft foam rubber ball, a hollow vinyl ball or the like. Bowling ball 40 may include finger holes 42 and a thumb hole 44.

When a pin 22 is hit by ball 40, the impact causes the pin to pivot rearwardly and downwardly as indicated by arrow 46 in FIG. 2. As a pin falls downwardly and rearwardly, the underside of flange 28 and rounded bottom 30 disengage from angled bowling surface 14 and depression 20, respectively. The pin is long enough to hit a pin standing in a row behind it and can, if hit properly, cause that pin to also fall down and back. After pin 22 is dislodged from its set position, the biasing force of elasticized tether 32 will retract the pin down into well 16. Each well 16 is deeper than pin 22 is high so that the pin lies entirely within the recessed well as illustrated in the left-hand part of FIG. 2. However, well 16 is not so deep as to preclude pin 22 being easily grasped and pulled up against elasticized tether 32 for resetting the pin with rounded bottom 30 in depression 20.

While a particular embodiment of the present invention has been shown and described, changes and modification will occur to those skilled in the art. It is intended in the appended claims to cover all such changes and modifications as fall within the true spirit and scope of the present invention.

What is claimed as new and desired to be secured by Letters Patent is:

1. A toy bowling game comprising in combination:
a bowling lane supportable on a surface;
the bowling lane providing a substantially planar bowling surface;
the bowling surface having a front edge and a back edge;
a plurality of pins;
each of the pins being of the same predetermined height;
at least one end of the substantially planar bowling surface being disposed above the supporting surface a distance greater than the predetermined height of the pins;
a plurality of wells recessed below the bowling surface;
each of the wells having a top and a bottom;
each of the wells being of the same predetermined depth;
the predetermined depth of each of the wells being greater than the predetermined height of each of the pins;
each of the wells having a front upper edge disposed toward the front edge of the bowling surface;
a depression in the bowling surface at the front upper edge of each of the wells disposed toward the front edge of the bowling surface;
means tethering each pin to the bottom of a respective well; and
the pins each having a bottom configuration that fits into the depression when the pins are set in an upright position adjacent the top of the well.

2. The toy bowling game of claim 1 including:
a flange on the pin surrounding and disposed above the bottom projection;
the flange having an underside; and
part of the underside of the flange engaging the bowling surface.

3. The toy bowling game of claim 1 in which:
the depression is part of a sphere;
the bottom configuration is a hemisphere; and
the radii of the part of a sphere and the hemisphere are substantially equal.

4. The toy bowling game of claim 1 in which:
there are a plurality of wells and an equal plurality of pins; and
the predetermined height of each of the pins is greater than the distance between any one pin and another pin that is disposed to the rear of the one pin when the pins are set in the upright position.

5. A toy bowling game comprising in combination:
a bowling lane supportable on a surface;
the bowling lane providing a substantially planar bowling surface;
a plurality of pins;
each of the pins being of the same predetermined height;
at least one end of the substantially planar bowling surface being disposed above the supporting surface a distance greater than the predetermined height of the pins;
a plurality of wells, equal to the plurality of pins, recessed below the bowling surface;
each of the wells having a top and a bottom;
each of the wells being of the same predetermined depth;
the predetermined depth of each of the wells being greater than the predetermined height of each of the pins;
means tethering each pin to the bottom of the respective well;
each of the pins being adapted to be positioned adjacent the top of a respective well and to pivot rearwardly and fall into the respective well when dislodged from adjacent the top;
the predetermined height of each of the pins being greater than the distance between any one pin and another pin that is disposed to the rear of the one pin when the pins are in an upright set position so that the one pin when dislodged may pivot rearwardly and dislodge another pin that is disposed to the rear of the one pin.

6. The toy bowling game of claim 5 in which the tethering means is elasticized.

7. The toy bowling game of claim 1 in which the tethering means is elasticized.

* * * * *